US005547088A

United States Patent [19]

Belokin et al.

[11] Patent Number: 5,547,088

[45] Date of Patent: Aug. 20, 1996

[54] REMOVABLE DISPLAY RACK ASSEMBLY

[76] Inventors: Paul Belokin; Martin P. Belokin, both of P.O. Box 1907, Denton, Tex. 76202; Norman P. Belokin, 3341 Evers Pky., Denton, Tex. 76207

[21] Appl. No.: 174,512

[22] Filed: Dec. 28, 1993

[51] Int. Cl.[6] ..... A47F 5/00

[52] U.S. Cl. ..... 211/87; 211/103; 211/106; 211/90; 248/206.4

[58] Field of Search ..... 211/90, 106, 88, 211/87, 59.1, 57.1, 103; 248/205.5, 206.3, 206.4

[56] References Cited

U.S. PATENT DOCUMENTS

| | | | |
|---|---|---|---|
| 1,243,059 | 10/1917 | Friesleben | 211/90 |
| 2,166,708 | 7/1939 | Sullivan | 211/71 |
| 2,605,906 | 8/1952 | Pontius | 211/106 |
| 3,194,406 | 7/1965 | Simeti et al. | 248/206.4 X |
| 4,376,521 | 3/1983 | Walters | 211/90 X |
| 4,984,693 | 1/1991 | Belokin et al. | 211/90 X |
| 5,096,272 | 3/1992 | Belokin et al. | 211/90 X |
| 5,330,261 | 7/1994 | Bennett | 211/88 X |
| 5,348,168 | 9/1994 | Emery | 211/90 X |

*Primary Examiner*—Robert W. Gibson, Jr.
*Attorney, Agent, or Firm*—Jack A. Kanz

[57] ABSTRACT

A removeable rack assembly is supported on a smooth transparent surface with suction cup devices. The assembly includes a rack and rack supports, each rack support including a vertical leg and a horizontal leg with connector means provided along the vertical leg for adjustably positioning a rack or rack shelf. A plurality of suction devices are provided with at least two suction devices positioned along a common horizontal axis of the horizontal leg and at least one suction device positioned at the lower end of the vertical leg. The lower end of the rack supports are adapted to rest on a sill or floor to support part of the vertical load applied to the rack.

15 Claims, 7 Drawing Sheets

REMOVABLE DISPLAY RACK ASSEMBLY

This invention relates to display rack assemblies which can be removeably attached to the surface of a wall, window, glass door or other rigid transparent surface using suction cup devices. More particularly, it relates to display rack assemblies with variable vertical heights which can be attached or detached quickly on the inside surface of a transparent panel for display of products.

BACKGROUND OF THE INVENTION

Display cabinets such as coolers and freezers contain a number of conventional shelves on the interior of the cabinet in which products are displayed. Typically, the cabinet has a door having a large transparent panel through which the products on the shelves are viewed. Between the cabinet door and interior shelving there is usually dead space due to the cabinet wall thickness. This dead space can be used by mounting a rack on the interior surface of the transparent panel of the door. Since the panel is usually made of glass or a plexiglass material, attachment means typically extend to the frame of the panel resulting in an obstructed view of the products enclosed in the cabinets. Preferably the rack should not obstruct the customer's view of the products and should be moveable and yet have a large load carrying capacity.

Department stores, convenience stores and other retail shops often have windows which are used to display goods. These windows typically display a limited selection of goods because the goods are usually arranged on a table, a staged floor or some other prop. Shelving can be constructed adjacent or in the window, but structural members of conventional shelving obstruct the customer's view of the goods on display or the interior of the store. Preferably the rack shelf should be lightweight and mountable on a large pane of glass adjacent the sill of a window or floor to optimize its load carrying capacity.

Suction devices are commonly used to mount and secure objects to smooth surfaces such as the surfaces of glass, plastic, formica, glazed tile, metal, etc. The typical suction device includes a cup body and a stem. The cup body is generally arcuate or circular and defines a concavity. Typically the stem is integrally formed on the body and used as the place of attachment for the object to be supported by the suction cup device. At least the body of the suction device is made of rubber, plastic or other material having sufficiently resilient properties such that when the body is pressed against a smooth surface the volume of concavity is reduced, forcing air to be expelled so that the body forms an air-tight seal against the smooth surface. Atmospheric pressure outside the body retains the cup body against the surface. When the air-tight seal is broken, air rushes into the concavity, releasing the suction attachment to the surface and the resilient material of the cup body returns to its relaxed condition. The resilient suction cup device can be repeatedly reused.

Problems often arise in use of suction devices in that they are difficult to properly position. Once a suction device is attached to a surface, the suction forces (atmospheric and friction) resist repositioning of the cup. Attachment of the suction device to an object can also be a problem. Preferably, the attachment should be releasable.

U.S. Pat. No. 2,221,238 to S. L. Johnson discloses a suction cup having normally closed slits in the stem communicating with the concavity of the suction cup body and a C-shaped clamp for connecting an object to the stem. The suction cup is particularly adapted for mounting a vibrating object such as a typewriter to a horizontal surface. The slits operate similarly to a one-way valve. When the suction cup is pressed against a surface (during installation or downward vibration of the object) air pressure developed in the compressed concavity of the suction cup is expelled through the slits, resulting in creation of a vacuum within the cup body. Outside atmospheric pressure acting on the stem tends to keep the slits closed, thus preventing the entrance of air into the cup. When the body is forcefully lifted vertically away from the surface, the C-shaped clamp presses upwardly against the stem, which stretches the walls of the stem, thereby opening the vent slits and permitting air to enter into the cup to relieve the vacuum and release the cup from the supporting surface.

U.S. Pat. No. 2,319,727 to J. E. Duggan discloses a vented suction cup having a valve in the suction cup body. When it is desired to remove the cup structure from the mounting surface, the valve is pulled sufficiently to distort the rubber and open an air passage. Thus, air from the atmosphere may enter the body of the suction cup to destroy the vacuum and release the cup from the mounting surface.

U.S. Pat. No. 4,196,882 to Rognon discloses a double suction cup holder in which two oppositely oriented suction cups are connected by a shared stem. The double suction cup holder can be used to secure objects such as memo pads to a flat surface. A longitudinal air passageway through the stem connects the concavities of the two cups. An opening traverses the passageway and has a valve member rotatably positioned therein. The valve member has inter-communicating longitudinal and diametrical bores. When the valve is turned so that its diametrical bore communicates with the air passageway in the stem, the vacuum in the cups is spoiled, thereby releasing the cups from the two surfaces.

Another problem arises when a large load is to be carried by suction devices. One solution is to increase the suction cup size, thereby increasing the force needed to remove the suction device from the surface to which it is mounted, but the maneuverability of the device is decreased. Another solution is to use two or more suction devices. However, in the typical arrangement the suction devices are mounted so that the load is not evenly distributed between the suction cups and the load will cause one of the devices to become disengaged before the other. As a result, when the first cup fails, the second suction cup experiences the full load and it too becomes disengaged. Preferably, a rack employing suction devices which is to carry a large load should minimize the size of the suction devices and maintain the rack's adjustability without compromising its load carrying capacity.

SUMMARY OF THE INVENTION

In accordance with the present invention, lightweight removeable shelf rack assemblies are used for supporting products adjacent a surface such as a wall, pane of glass, etc. The rack assembly includes one or more "T"-shaped rack support mounting strips, a plurality of suction devices, at least one rack shelf, and rack support brackets.

The "T"-shaped rack support mounting strips have a channelled cross-section, can be fabricated from plastic or metal and are installed in the vertical plane with a horizontal leg member positioned at the top and a vertical leg member extending downwardly from the horizontal leg. The flange of the channel extends around substantially the entire periphery of the mounting strip. The flange surface at the lower end of the vertical leg provides a vertical bearing surface and the edge of the entire flange provides a bearing surface in the horizontal plane. At the top and bottom ends of the mounting strip, apertures are provided for receiving suction cup stems. At least two apertures are provided at the top end and positioned in the horizontal leg along a common horizontal axis. One aperture is provided at the lower end of the vertical leg and additional apertures may be provided intermediate the top and bottom ends, if desired.

A plurality of apertures is also provided in the web of the mounting strip forming at least one vertical row of spaced apertures along the length of the vertical leg of the mounting strip. These apertures are adapted to receive bracket bolts, screws or other connector means extending from the rack or rack support brackets.

The suction devices employed herein preferably have a generally cup-shaped body with an inner surface which defines a concavity. When the suction device body is positioned adjacent a smooth surface for mounting an object, the inner surface of the suction device and the smooth surface define a closed chamber. The suction device includes a duct, passageway or bore communicating between the concavity and the outside atmosphere. A valve element is provided for selectively opening or closing the duct, passageway or bore so that the suction cup can be easily released from the smooth surface for repositioning the suction cup against the surface. The suction device also has a stem (for connecting the suction cup body to an object to be mounted adjacent a surface) including a valve element for selectively opening or closing the duct or bore. Preferably, the stem includes a removeable central plug which performs as a valve element for selectively opening and closing the duct or bore so that the suction cup can be easily released from the smooth surface for repositioning. In general, any of the arrangements described in U.S. patent application Ser. No. 08/148,905, filed Nov. 15, 1993, entitled Releasable Suction Cup Assembly may be used as the suction device disclosed herein to mount the removeable rack assembly on a generally vertical, rigid, smooth surface.

BRIEF DESCRIPTION OF THE DRAWING

The accompanying drawing is incorporated into and forms a part of the specification to illustrate several examples of the present invention. The drawing is only illustrative of preferred and alternative examples of the invention and is not to be construed as limiting the invention in any way. Various advantages and features of the invention will become more apparent from the following detailed description taken in connection with the appended claims and attached drawing in which:

DESCRIPTION OF PREFERRED EMBODIMENTS

Figure 1:
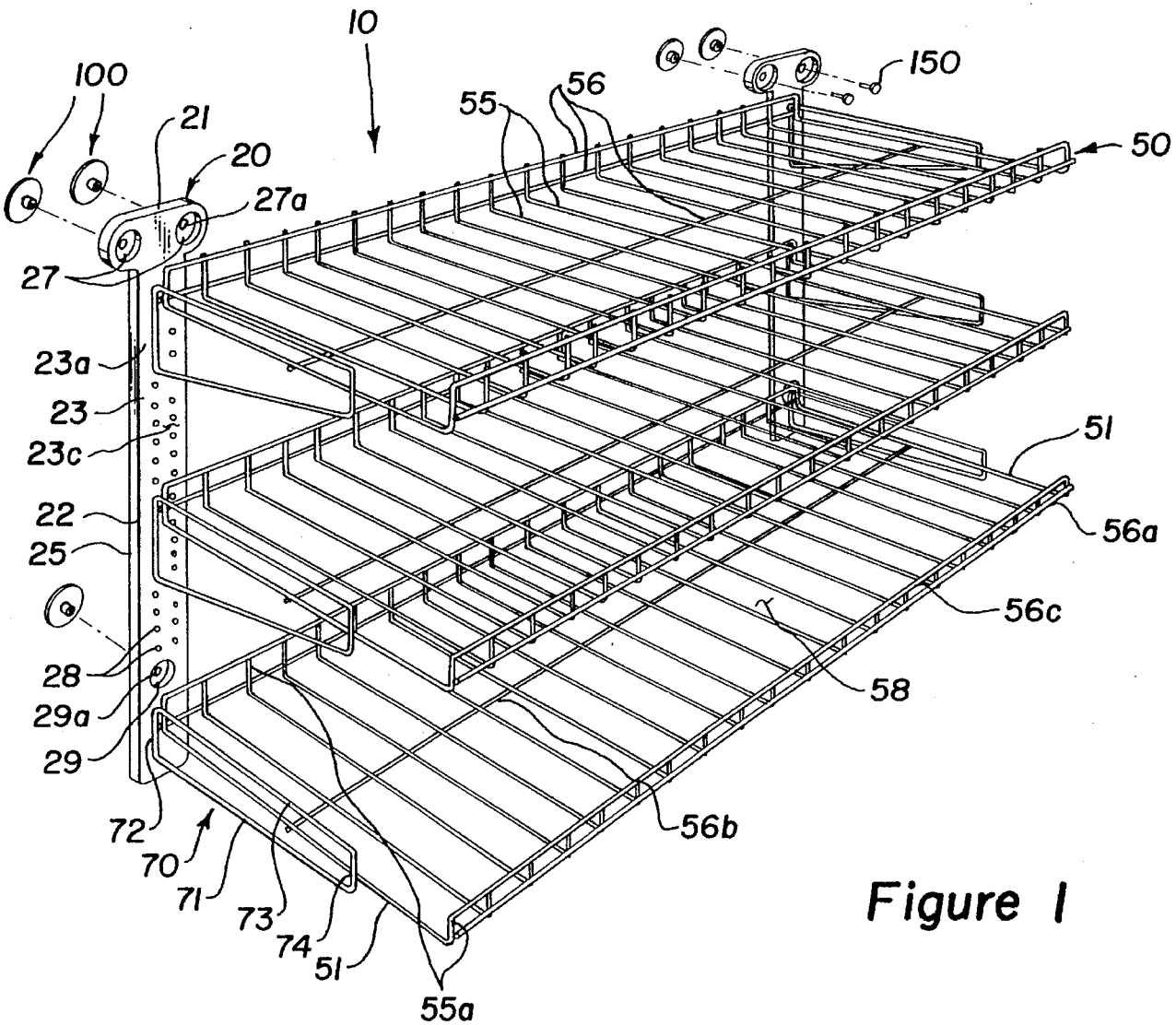
FIG. 1 is a perspective view of one embodiment of the removeable rack,assembly of the invention.

Presently preferred embodiments of the invention are described herein by referring to various examples of how the invention can be made and used. Like reference numerals are used throughout the description and the several views of the drawing to indicate like or corresponding parts. In addition, references made to horizontal and vertical planes are intended to describe the installed position; that is, the rack shelves are in the global horizontal plane and the mounting strips are in the global vertical plane.

As illustrated in FIG. 1, the removeable rack assembly 10 includes a plurality of rack shelves 50, a plurality of rack support brackets 70, at least two "T"-shaped mounting strips 20, and a plurality of suction devices 100. The "T"-shaped mounting strips 20 illustrated in FIG. 1 are preferably molded transparent plastic to minimize the weight of the assembly and to provide an unobstructed view of the products supported on the rack shelf. Each strip has a horizontal leg 21 and a vertical leg 22. A plurality of apertures 28 are provided along the vertical axis of vertical leg 22 for receiving connectors 75 (see FIG. 7) on rack support bracket 70. In the embodiment of FIG. 1, two rows of apertures 28 are provided. In an alternate embodiment, however, a single row of apertures 28 can be provided.

Horizontal leg 21 of the "T"-shaped mounting strip 20 has two apertures **27*a* positioned along a common horizontal axis for receiving suction devices 100. Vertical leg 22 has one aperture 29*a* located at the lower end of the vertical leg 22 for receiving a suction device 100. Each aperture 27*a* and 29*a* is inset in a large diameter circular recess 27 and 29. The depth of recesses 27 and 29 is slightly greater than the thickness of suction device stem 120 and a removeable retainer 150. The position and arrangement of the upper suction devices 100 result in the load exerted by the rack shelves 50 being evenly distributed between the two suction devices 100** aligned in a common horizontal plane.

Figure 3:
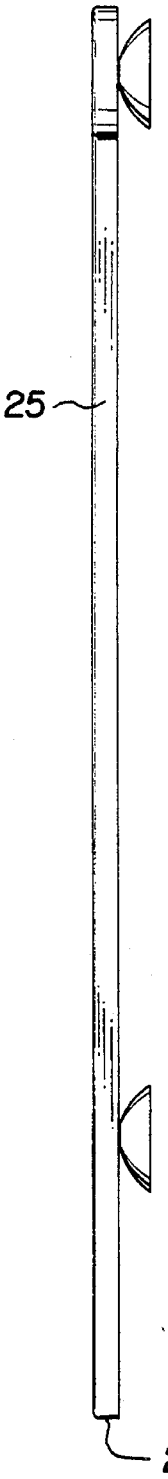
FIG. 3 is a side elevational view of the "T"-shaped member of FIG. 2.
Figure 4:
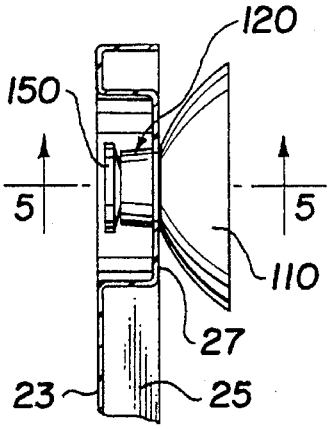
FIG. 4 is cross-sectional view of the "T"-shaped member of FIG. 2 taken along line 4—4.
Figure 2:
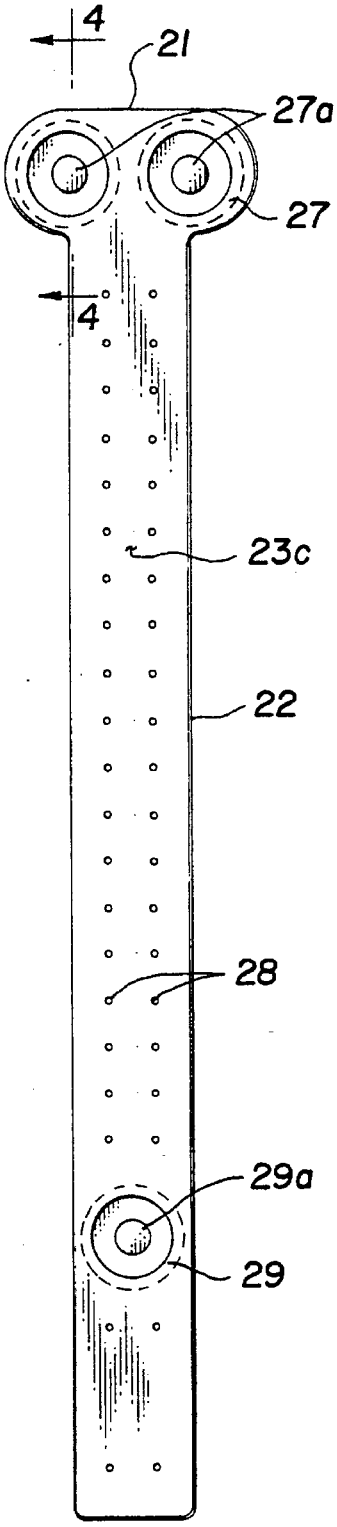
FIG. 2 is an elevational view of one embodiment of the "T"-shaped strip member of the invention.

Mounting strip 20 has a channeled cross-section with the flange 25 of the channel (see FIG. 3) extending substantially around the entire periphery of the mounting strip 20. The depth of flange 25 can be varied and is controlled by several factors. The flange 25 must be deep enough to accommodate the connectors 75 used to connect the rack support bracket 70 to the mounting strip 20 where connectors project from the back surface 24 of the mounting strip web 23. To increase the load carrying capacity of the rack assembly 10, the lower end of the mounting strip's vertical leg 22 can be mounted adjacent a sill or other horizontal rigid surface, in which case the point of contact is the vertical leg's lower flange **25*c*. Therefore, in addition to accommodating the connector 75 projection, the flange 25 also provides a bearing surface 25***c* for vertical loads when the mounting strips 20 are mounted adjacent a sill or other vertical support. In addition, the depth of the flange 25 is influenced by the desired stiffness of the mounting strip 20. However, this is limited by the desired stiffness of the flange 25 when the mounting strip 20 is mounted adjacent a sill and the lower portion of flange 25*c* is acting as a bearing surface. The flange 25 is also limited by the thickness of the depressed suction cup body 114. If the thickness of the flange exceeds the thickness of the suction cup 110 when fully compressed, the flange 25 may prevent the suction cup from being fully compressed.

The combined effect of the flange 25 extending around the periphery of the mounting strip 20, the horizontal leg 21 at the top of the mounting strip 20, and the two or more suction devices 100 positioned along a common horizontal axis in the horizontal leg 21 is to cause the load exerted on the rack shelf 50 to be evenly shared by the suction devices 100. As the rack shelf 50 is loaded, it transfers a shear load and a moment to face 23*c* of the web 23. As a result, a vertical shear force is transferred to the upper suction devices 100. This force is transferred evenly because the suction devices 100 are equidistant from the central axis of the web 23 of the vertical leg 22. Due to the flexibility of the mounting strip 20, an axial load is also developed at the suction devices 100 from the moment at the web's face 23*c*, which is also distributed evenly between the suction devices because they are equidistant from the central axis of the vertical leg. When the mounting strips 20 are positioned adjacent a sill or other support, the mounting strips act more like columns than beams and the load on the suction devices 100 is greatly reduced. Instead, the suction devices 100 primarily provide lateral support needed for a structural column having a high KL/R ratio.

In an alternate embodiment the mounting strip 20 is fabricated from metal. In other embodiments, the flange 25 does not extend around the entire periphery of the mounting strip 20. Instead, it extends along the vertical leg 22 of the mounting strip 20.

Rack shelf 50 is preferably constructed of a plurality of wire sections 55 arranged in parallel relationship to define the horizontal plane 58 of the rack shelf 50 and are secured together with wire bracing 56 running perpendicular to the parallel wire sections 55. The distal ends of the parallel wire sections 55 are bent upwardly to form vertical walls 55*a* to prevent products sliding off the rack shelf 50. As illustrated, bracing 56 includes a centrally positioned brace 56*b* extending from one end 51 to the other end 51 of the rack shelf 50; braces 56*a* at each juncture of the horizontal plane 58 of the rack shelf 50 and the vertical wall 55*a* formed by the parallel wire sections 55; and braces 55*c* at the top of the two vertically extending walls 55*a*. In another arrangement, the rack shelf 50 is constructed of plastic sections which have a circular cross-section. In yet another arrangement, the plastic sections have a rectangular cross-section.

Rack support brackets 70 are positioned at opposite sides 51 of each rack shelf 50 and run parallel with the parallel wire sections 55 which form the rack's horizontal plane 58. The rack support bracket 70 in the embodiment illustrated in FIGS. 1–7 is formed by wire bent into a triangular-shaped member 70 with one base 72 of the triangle bearing against the vertical mounting strip web surface 23*a* and the adjacent base 73 positioned in parallel relationship with the horizontal plane 58 of the rack shelf 50. The rack support bracket 70 is secured to the rack shelf 50 where the rack support bracket 70 abuts the side 51 of the rack shelf 50 at the face 23*a* of the mounting strip 20 and at the distal end 74 of the bracket 70 where it abuts the side 51 of the rack shelf 50. In FIGS. 1–7 the distal end 74 of the bracket is squared off to increase the connection surface area. In the embodiment of FIG. 7, the rack support bracket 70 is secured to the vertical mounting strip 20 by threaded connectors 75 and nuts 76.

Figure 8:
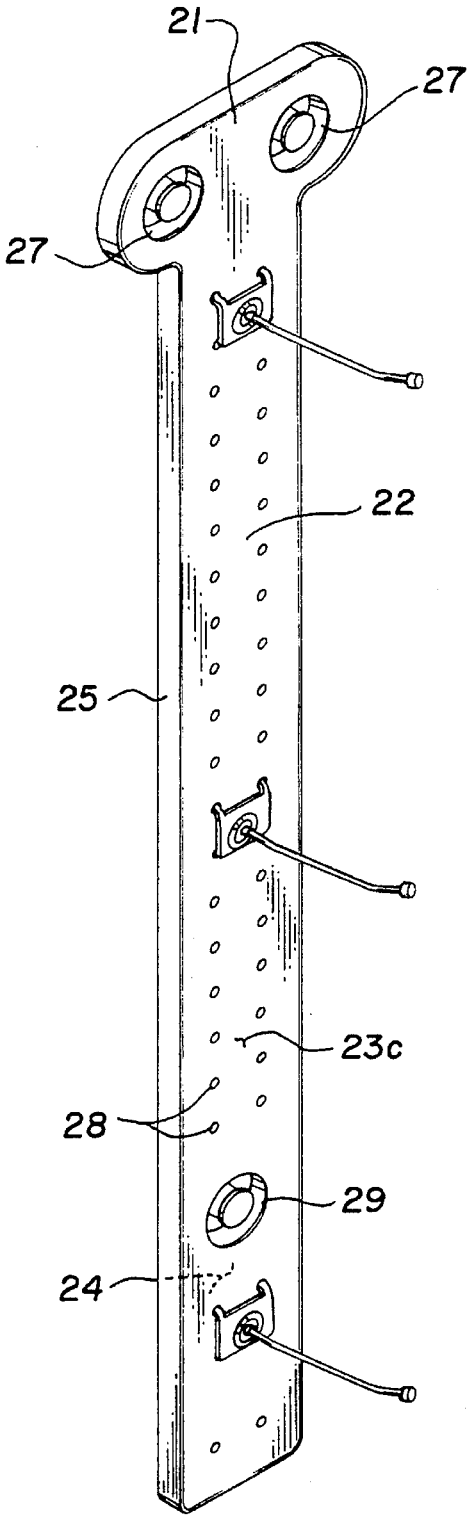
FIG. 8 is a perspective view of another embodiment of the "T"-shaped strip and rack of the invention.
Figure 9:
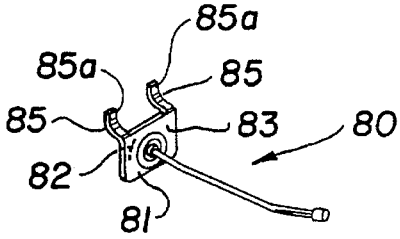
FIG. 9 is a perspective view of an alternate embodiment of a rack of the invention.
Figure 10:
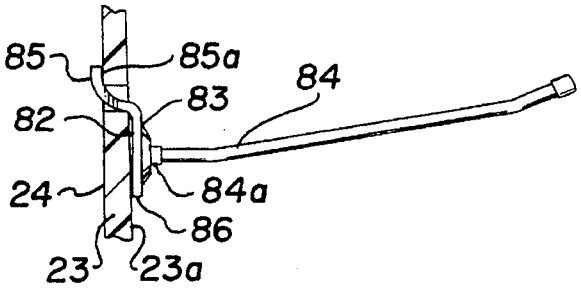
FIG. 10 is a fragmentary sectional view of the "T"-shaped strip and rack assembly of FIG. 8.

An alternate embodiment of the removeable rack assembly 15 is illustrated in FIGS. 8–10. The assembly 15 includes one or more "T"-shaped mounting strips and a plurality of racks 80. The design of rack 80 incorporates the connector means into the rack structure. The rack 80 consists of a rectangular base 81, two prongs 85 projecting from the underside 82 of the base 81 curved in an upward direction for positioning in the apertures 28 of the "T"-shaped mounting strip 20, and an arm 84 extending from the central portion of the base front 83. The arm 84 is preferably formed of heavy gauge wire or small diameter rod and is slightly tapered upwardly from its anchor point 84*a* in the base 81. Downward rotation of the rack support bracket 80 is prevented by the tips 85*a* of the projecting prongs 85 bearing against the back 24 of the "T"-shaped mounting strip 20 and the lower edge 86 of the base 81 bearing against the top surface 23*a* of the web 23.

The rack 80 may, of course be made of transparent plastic and may be secured to the mounting strip 20 by downwardly projecting hooks inserted into the apertures 28. A channel or other depression may be formed in the front face of web 24 and the base of rack 80 fitted into such channel or depression for further stabilizing the rack. Various other means of attaching the rack 80 to the vertical strip 20 may be used as desired.

Figure 11:
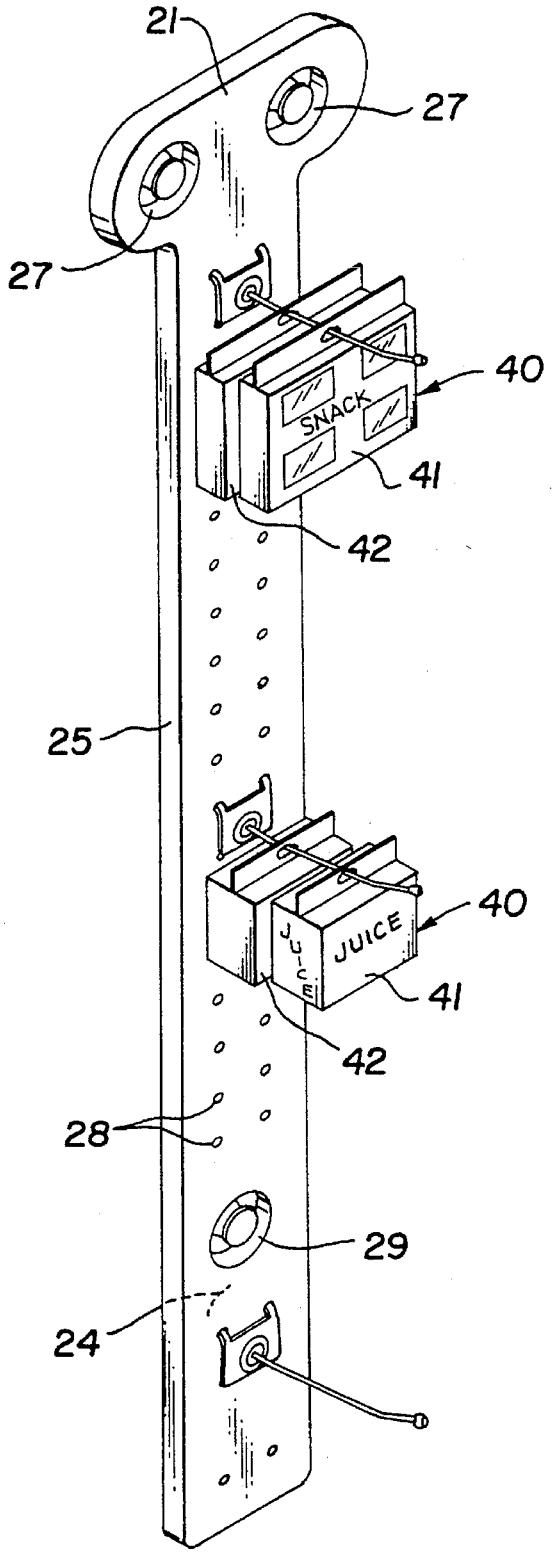
FIG. 11 is a front perspective view of the rack assembly of FIG. 8 in combination with and supporting display packages.
Figure 13:
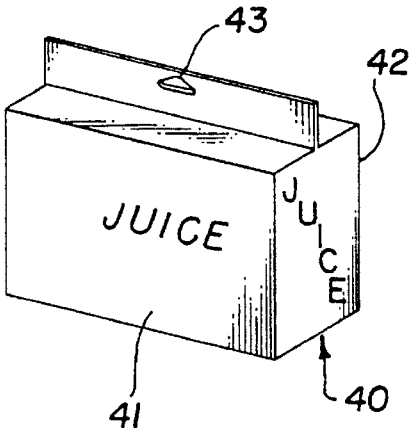
FIG. 13 is a perspective view of a display package.
Figure 12:
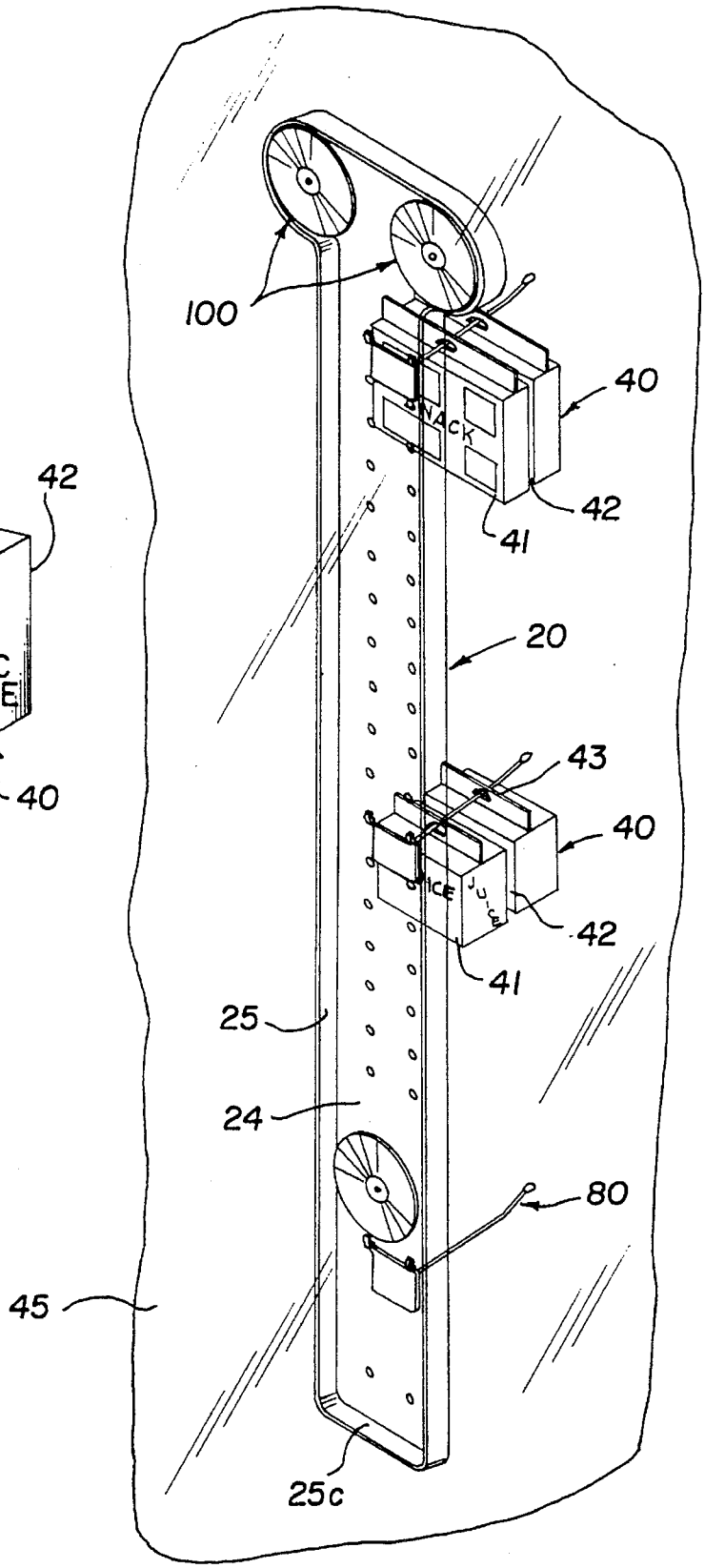
FIG. 12 is a back perspective view of the rack assembly of FIG. 8 as viewed through a transparent wall.

As illustrated in FIGS. 11 and 12, display products 40 may be supported from rack 80 with package connectors 43 or other suitable connector means. Each package includes a front display side 41 and a back side 42. The arrangement of display package 40 illustrated in FIGS. 11 and 12 includes positioning the display packages 40 so that the package 40 nearest the "T"-shaped mounting strip 20 is placed with the front display side 41 facing toward web 23 of mounting strip 20. All remaining display packages 40 on the same rack face in substantially the opposite direction, resulting in the front display side 41 of the package facing away from the web 23 of the "T"-shaped mounting strip 20. The effect of the arrangement is to allow customers to see the front display side 41 of the display products 40 supported by the removeable rack assembly 15 from the front of the removeable rack assembly 10 and from the back of the removeable rack assembly 10 through a transparent wall 45.

In yet another arrangement (not shown), a plurality of removeable rack shelves 50 may be positioned in parallel spaced relationship with the racks 80 extending from each "T"-shaped mounting strip 20 providing support for at least one rack shelf.

Figure 5:
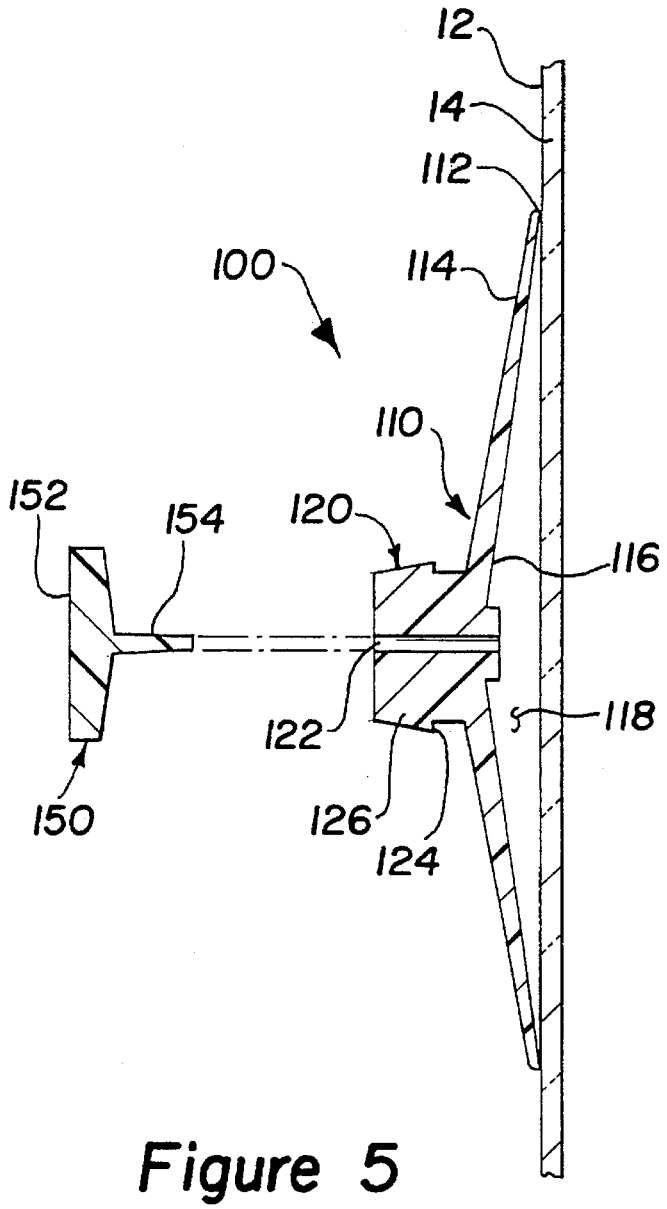
FIG. 5 is an exploded sectional view of the suction device shown in FIG. 4 taken along line 5—5.
Figure 6:
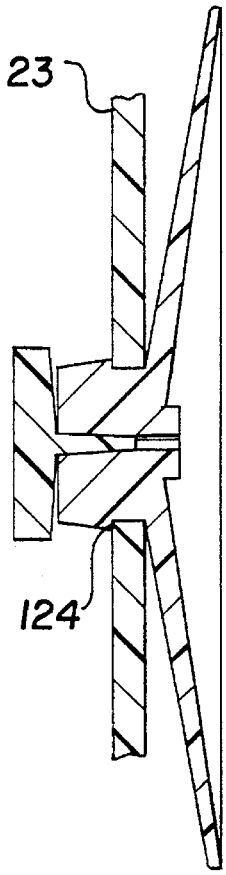
FIG. 6 is an assembled sectional view of the suction device shown in FIG. 5.
Figure 7:
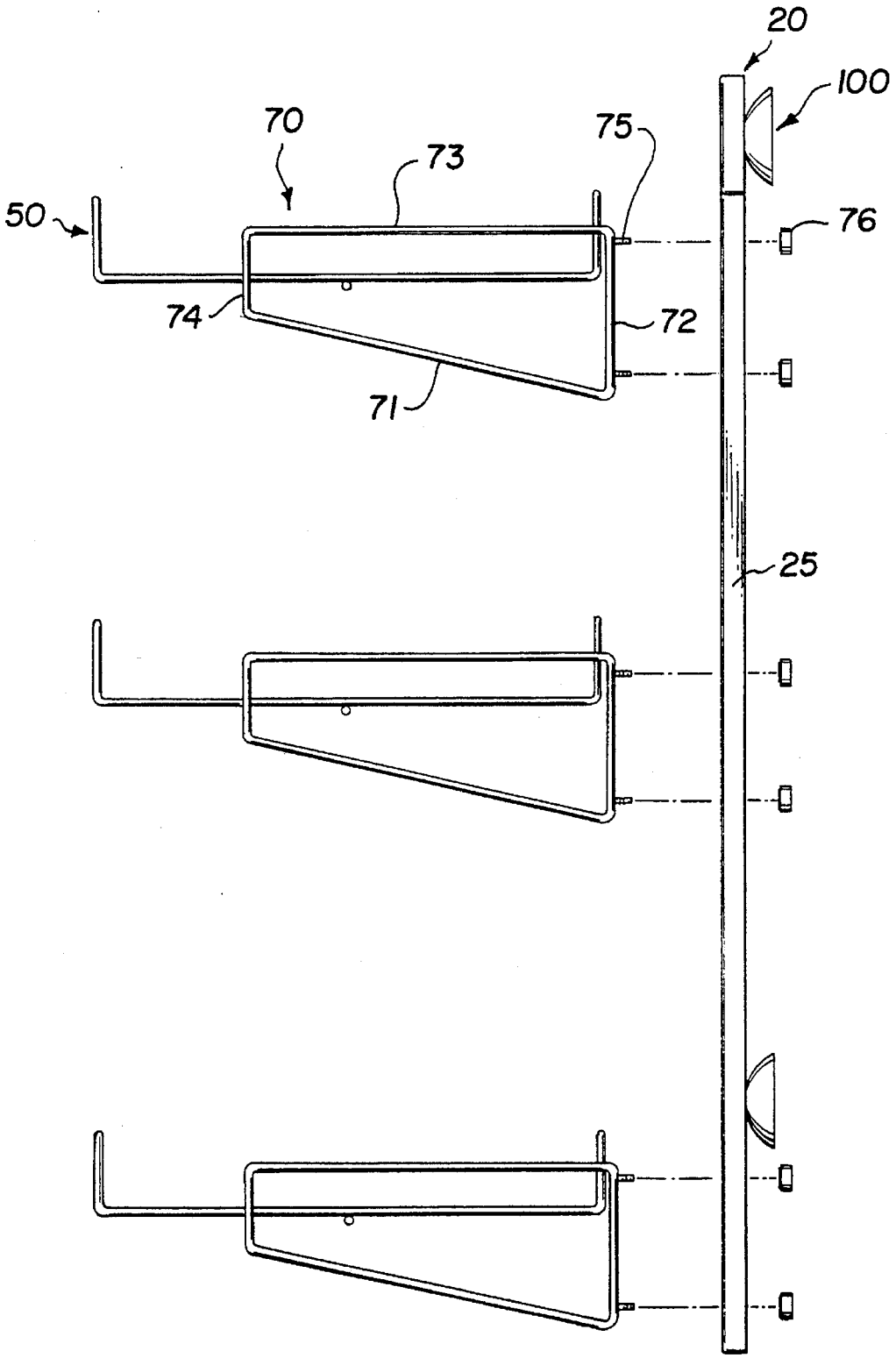
FIG. 7 is an exploded side elevational view of one embodiment of the removeable rack assembly of the invention.

The structure and operation of the suction device 100 is illustrated in FIGS. 5 and 6. The suction device 100 generally comprises a suction cup body 110, a stem 120 and a retainer 150. The suction cup body 110 is generally cup-shaped and has a peripheral edge 112, an outer surface 114 and an inner surface 116 which defines a concavity. The peripheral edge 112 of suction cup 110 is preferably circular. However, it could be of other generally cup-like shapes.

When the suction cup 110 is positioned adjacent a smooth surface such as surface 12 of glass pane 14, the inner surface 116 and surface 12 substantially close the concavity to form a chamber 118. The body of cup 110 is primarily made of resilient material such as rubber or plastic and has sufficiently resilient properties such that when pressed against a smooth surface, the suction cup 110 is deformed and flattened on the surface 12 and the volume of chamber 118 is greatly reduced. As the volume of the chamber 118 is reduced, air is expelled from the chamber 118. The deformable body of the suction cup 110 conforms to the smooth surface 12 and forms an air-tight seal against the smooth surface 12. Atmospheric pressure acting on the outer surface 114 of the suction cup 110 retains the suction cup against the smooth surface 12.

A stem portion 120 is formed on the body of suction cup 110. The stem portion 120 is generally cylindrical in shape and preferably formed of the same resilient material. The stem portion 120 has a duct 122 therethrough which communicates between the chamber 118 and the outer atmosphere. Preferably, the duct 122 is generally cylindrical in shape. As illustrated in FIGS. 5 and 6, the stem portion 120 has an expanded lip 124 which is used to maintain the horizontal leg 21 and vertical leg 22 having apertures 27 and 29 in the webs 23 of the legs 21 and 22 on the suction cup device 100. The retainer 150 is preferably formed of substantially non-resilient plastic material and has a top portion 152 and a central plug 154. Preferably, the central plug 154 is slightly tapered from the top portion 152 and adapted to act as a valve which plugs the duct 122, thereby sealing chamber 118. It will be readily understood, however, that various other designs of suction cups may be used.

To mount strips 20 on surface 12, the stem 120 is compressed and passed through the apertures 27 and 29 in the horizontal leg 21 and vertical leg 22 of mounting strip 20. Until the retainer 150 is positioned within the stem portion 120 as shown in FIG. 6, the chamber 118 defined by the inner surface 116 of the suction cup 110 and surface 12 is not sealed. However, once pressed into position as shown in FIG. 6, the central plug 154 of the retainer 150 prevents air from communicating between the chamber 118 and the outer atmosphere. The suction cup device 100 can be pressed against the surface 12 to expel air from the chamber 118 and the deformable suction cup 110 forms an air-tight seal against the smooth surface 12. Atmospheric pressure outside the body 110 retains the suction cup 110 against the surface.

If mounting strip 20 is not mounted in the desired position (or if it becomes desireable to change its position), the removeable retainer 150 can be loosened. This the duct 122 and breaks the vacuum seal of the suction cup 110. The mounting strip 20 or entire rack assembly 10 can then be easily repositioned as desired.

Even though numerous characteristics and advantages of the present invention have been set forth in the foregoing description together with details of the structure and function of the invention, the disclosure is illustrative only. Various changes and modifications may be made in detail, especially in matters of shape, size and arrangement of parts, within the principles of the invention to the full extent indicated by the broad general meaning of the terms used. The restrictive description and drawing of the specific examples above do not point out what an infringement of this patent would be, but are to provide at least one explanation of how to make and use the invention. The limits of the invention and the bounds of the patent protection are measured by and defined in the appended claims.

What is claimed:

1. A removeable rack assembly comprising:

(a) a rack shelf;

(b) an elongated rack support having an array of connectors for adjustably positioning the rack shelf longitudinally along the rack support; and (c) a plurality of suction devices on said rack support connectable to a flat surface.

2. A removeable rack assembly as defined in claim 1 wherein said elongated rack support comprises:

(a) a generally "T"-shaped member having a horizontal leg and a generally vertical leg; and (b) suction devices mounted on said legs.

3. A removeable rack assembly as defined in claim 2 wherein said vertical leg has a support surface positioned to engage a generally horizontal surface such that the weight of the rack shelf partially rests on said support surface.

4. A removeable rack assembly as defined in claim 1 wherein said rack support is substantially transparent.

5. A removeable rack assembly as defined in claim 1 wherein said rack support includes a flange extending around substantially the entire periphery thereof.

6. A removeable rack assembly comprising:

(a) a rack shelf;

(b) a first and second generally "T"-shaped rack support members channeled in cross-section, each said rack support member having a horizontal leg and a generally vertical leg and a plurality of connectors for adjustably vertically positioning the rack shelf along said rack support members; and (c) a plurality of suction devices connectable to a flat surface on each of said rack supports.

7. A removeable rack assembly as defined in claim 6 wherein each of said elongated rack supports further comprises a flange extending substantially around the entire periphery of said rack support member.

8. A removeable rack assembly comprising:

(a) first and second "T"-shaped rack supports, each having a vertical leg and a horizontal leg with each leg defining a web and a flange extending around substantially the entire periphery of said rack support with an array of apertures in said web;

(b) a plurality of suction devices connectable to a flat surface portioned on each of said rack supports; and (c) a rack shelf supported in said apertures.

9. A removeable rack assembly as defined in claim 8 wherein at least two of said suction devices on each of said rack supports are positioned along a common horizontal axis of said horizontal leg.

10. A removeable rack assembly as defined in claim 8 wherein said rack support is substantially transparent.

11. A removeable rack assembly comprising:

(a) a rack shelf;

(b) at least two elongated rack support members adapted for mounting said rack shelf adjacent a generally vertical surface, each rack support member having a channelled cross-section defining a flange extending substantially around the entire periphery of said member, a horizontal leg, a vertical leg and a plurality of apertures for receiving said rack shelf; and (c) a plurality of suction devices connectable to a flat surface positioned on each of said rack support members, at least two of suction devices positioned on said horizontal leg and having stems aligned in a common horizontal plane.

12. The combination comprising:

(a) an elongated substantially transparent rack support having an array of connectors for supporting and adjustably positioning a rack longitudinally thereon;

(b) a rack supported on said rack support;

(c) a plurality of suction devices removeably connecting said rack support to a vertically extending substantially transparent wall; and (d) a plurality of product display packages, each having a front display side and a back side, supported on said rack and arranged with the front display side of those packages adjacent said transparent wall facing said transparent wall and other product display packages facing in substantially the opposite direction.

13. The combination defined in claim 12 wherein said transparent wall is a substantially transparent panel in a door.

14. The method of displaying merchandise packaged in display packages having a front display side and a generally oppositely disposed back side comprising:

(a) mounting a generally elongated substantially transparent rack support having an array of connectors for supporting and adjustably positioning a rack longitudinally thereon on one face of a substantially transparent wall;

(b) supporting a rack on said rack support;

(c) arranging a plurality of display packages having a front display side and a generally oppositely disposed back side on said rack with the front display side of the display package nearest the transparent wall facing the transparent wall and the front display side of other display packages facing in substantially the opposite direction.

15. The method of claim 14 wherein said substantially transparent wall is a panel in a door of a refrigerated vault.

* * * * *

UNITED STATES PATENT AND TRADEMARK OFFICE

CERTIFICATE OF CORRECTION

PATENT NO. : 5,547,088
DATED : August 20, 1996
INVENTOR(S) : Belokin, et al.

It is certified that error appears in the above-indentified patent and that said Letters Patent is hereby corrected as shown below:

On title page, item [54]
The title should read ---REMOVEABLE DISPLAY RACK ASSEMBLY---

Col. 1, line 1, "REMOVABLE DISPLAY RACK ASSEMBLY" should read --- REMOVEABLE DISPLAY RACK ASSEMBLY---

Signed and Sealed this
Fifth Day of November, 1996

*Attest:*

Bruce Lehman

BRUCE LEHMAN

*Attesting Officer*

*Commissioner of Patents and Trademarks*